US009546505B1

(12) United States Patent
McEachern

(10) Patent No.: US 9,546,505 B1
(45) Date of Patent: Jan. 17, 2017

(54) ADJUSTABLE POSITION BLOCKING DEVICE FOR SLIDING CLOSURES

(71) Applicant: Marc McEachern, Kihei, HI (US)

(72) Inventor: Marc McEachern, Kihei, HI (US)

( * ) Notice: Subject to any disclaimer, the term of this patent is extended or adjusted under 35 U.S.C. 154(b) by 236 days.

(21) Appl. No.: 14/480,591

(22) Filed: Sep. 8, 2014

Related U.S. Application Data

(63) Continuation of application No. 13/350,773, filed on Jan. 14, 2012, now Pat. No. 8,881,557.

(51) Int. Cl.
*E05C 19/00* (2006.01)
*E05C 17/48* (2006.01)

(52) U.S. Cl.
CPC ..... *E05C 17/48* (2013.01)

(58) Field of Classification Search
CPC ..... Y10T 70/5173; Y10T 292/34; Y10T 292/379; Y10T 292/03; Y10T 292/17; Y10T 70/5146; E05C 19/182; E05C 17/60; E05B 15/1607
USPC ..... 292/302, 300, 137
See application file for complete search history.

(56) References Cited

U.S. PATENT DOCUMENTS 3,563,593 A * 2/1971 Leier ..... E05C 19/182 292/296
4,617,810 A * 10/1986 Fish ..... E05B 65/0894 70/14
4,833,737 A * 5/1989 Boucher ..... A47K 13/242 292/266
4,878,701 A * 11/1989 Rondel ..... E05C 19/182 292/288
5,819,561 A * 10/1998 Blehi, III ..... E05B 67/36 292/289
5,836,626 A * 11/1998 Coy ..... E05C 19/182 292/289
5,918,915 A * 7/1999 Calteux ..... E05B 65/0894 292/1
5,984,387 A * 11/1999 Zeller ..... E05C 19/182 292/288
6,755,450 B1 * 6/2004 Chen ..... E05C 19/182 292/289
8,881,557 B2 * 11/2014 McEachern ..... E05B 65/08 292/288
2005/0151382 A1 * 7/2005 Barber ..... E05C 17/525 292/288

* cited by examiner

*Primary Examiner* — Mark Williams

(57) ABSTRACT

An adjustable position blocking device for sliding closures that firmly attaches to a glass pane of a closure and limits the sliding translation of the sliding panels of the closure. One embodiment comprises an elongated track (30) which adheres to a glass pane with very high bonding double-sided tape (40). The one embodiment also comprises a blocking slider (10) that adjustably attaches to track (30) at a plurality of track positions and is substantially tall to block the sliding translation of the sliding panels. Slider (10) comprises a modular attachment means that permits the slider (10) to be customized with blocking modules (22, 86, 96) of different form and function. In addition, one embodiment comprises a blocking module (96) which integrates an electronic device to detect the opening of a sliding closure and alert a user, a remote device or a remote system.

8 Claims, 9 Drawing Sheets

FIG. 1
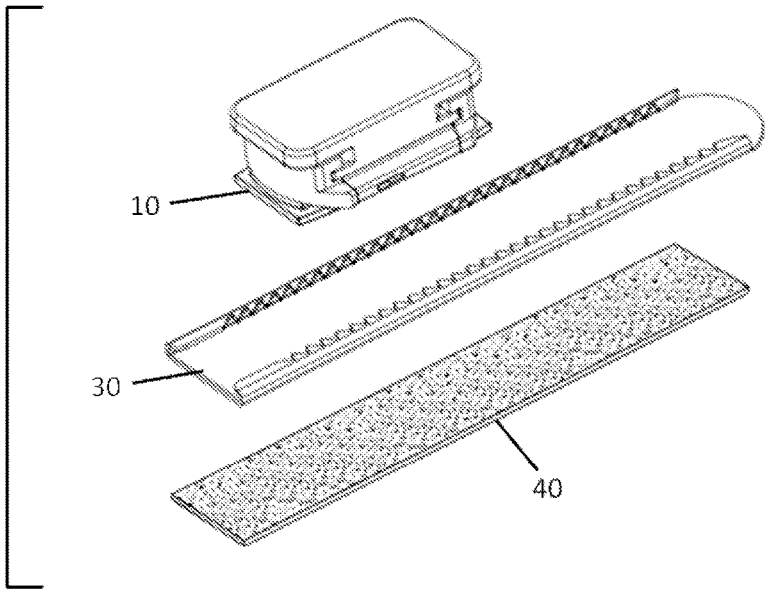
FIG. 2a
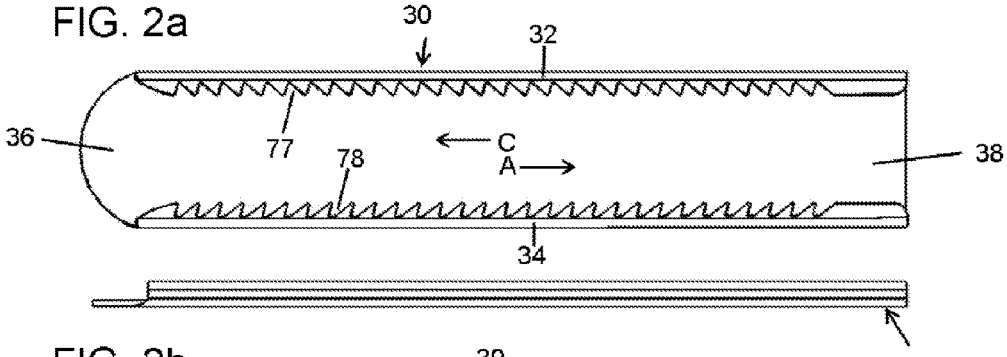
FIG. 2b
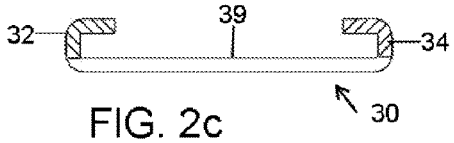
FIG. 2c

FIG. 3a
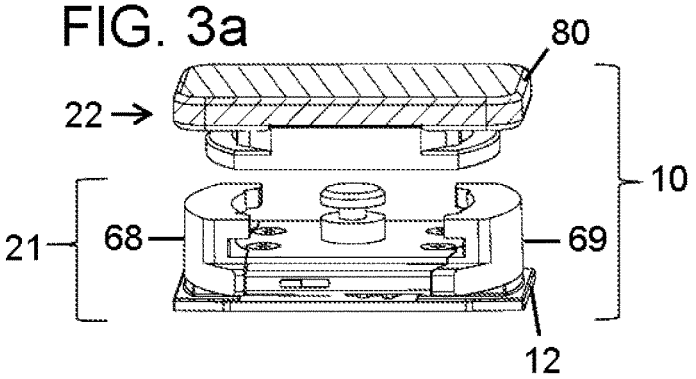
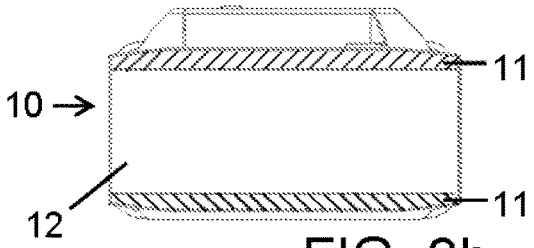
FIG. 3b
FIG. 4a
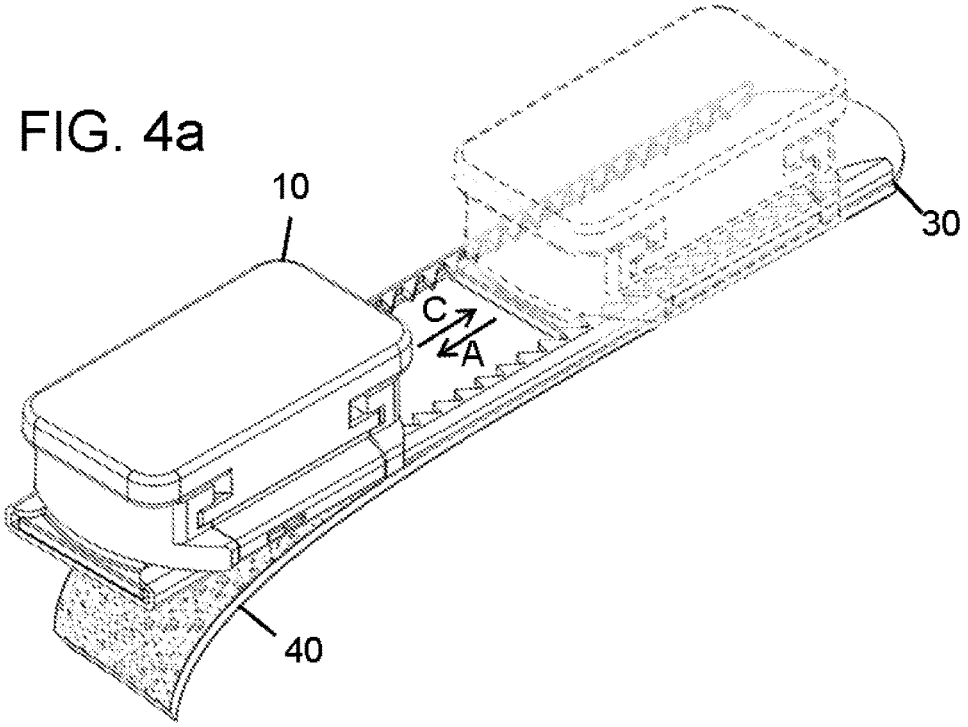

FIG. 9a
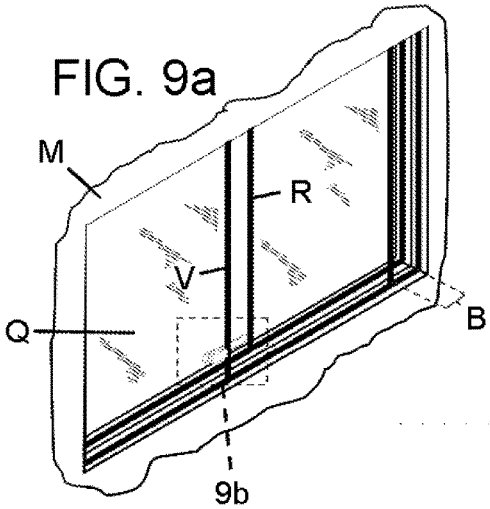
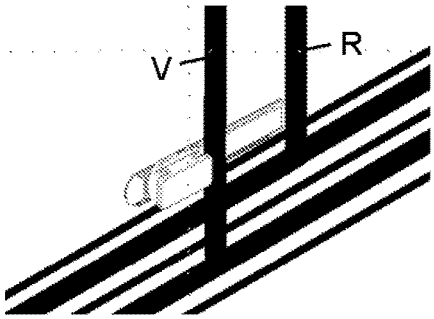
FIG. 9b
FIG. 9c
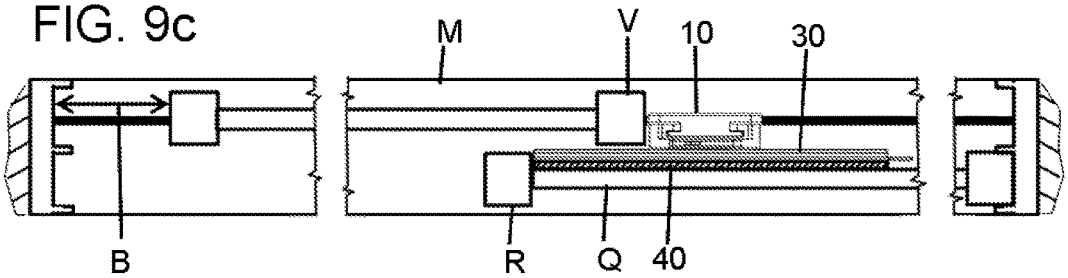

FIG. 9d
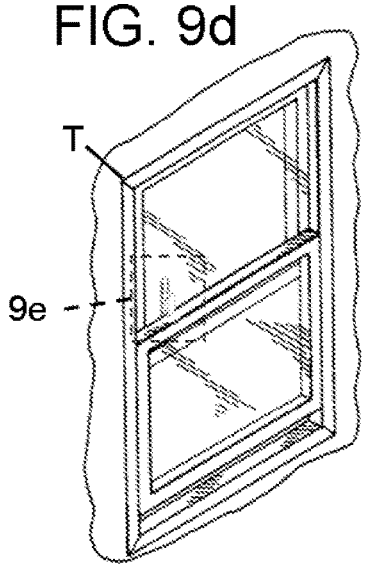
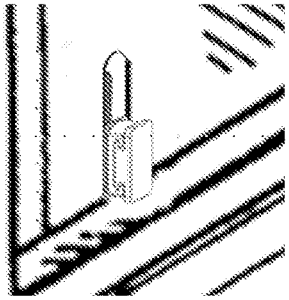
FIG. 9e
FIG. 10
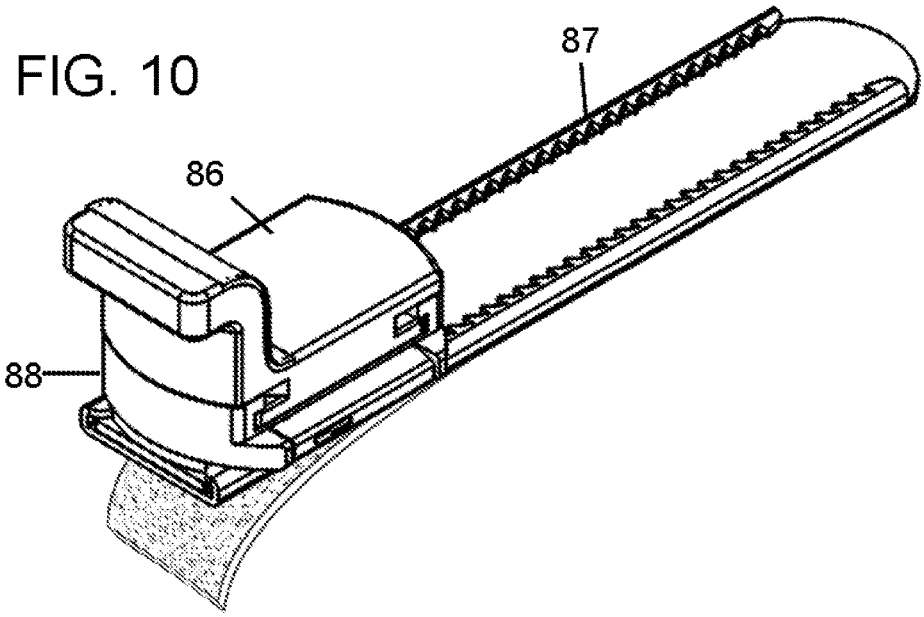

ADJUSTABLE POSITION BLOCKING DEVICE FOR SLIDING CLOSURES

CROSS-REFERENCE TO RELATED APPLICATIONS

This application is a continuation of U.S. patent application Ser. No. 13/350,773, filed Jan. 14, 2012.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND

Prior Art

The following is a tabulation of some prior art that presently appears relevant:

U.S. patents

| Pat. No. | Kind Code | Issue Date | Patentee |
|---|---|---|---|
| 3078524 | A | Feb. 26, 1963 | Minick |
| 5125699 | A | Jun. 30, 1992 | Dinan |
| 5409271 | A | Apr. 25, 1995 | Hoffmann |

U.S. Pat. application publications

| Publication Nr. | Kind Code | Publ. Date | Applicant |
|---|---|---|---|
| 20070194579 | A1 | Aug. 27, 2007 | Fiedler |
| 20070209414 | A1 | Sep. 13,2007 | Bentley |

Additional examples of prior art for sliding closure security devices may be seen in U.S. Pat. Nos. 3,938,839; 4,171,835; 4,274,666; 4,607,253; 5,437,486; 5,620,215; 6,264,252; 7,887,105 and 7,463, 577 B2.

Solutions for sliding window security devices include window latches and locks which are designed to prevent the sliding window from being opened from the outside. For purposes herein, a latch is a device in which mating mechanical parts engage to fasten but usually do not lock, whereas a lock fastens and is operated by a key or combination. Herein we will use the term fastener to refer to either a lock or a latch. There are many prior art window constructions comprising at least one slidable panel (also referred to as a sash in a number of window designs) offset in an independent track running the length of the window which is parallel to another slidable or fixed panel. In such window constructions, sliding panels slide past adjacent panels, thereby permitting the sliding window to be open to its full extent. A panel comprises a single or multiple glass pane structure framed with rails made from varying material such as wood, aluminum or polyvinyl chloride. Sliding windows having parallel panel construction comprise an outer panel and inner panel. The outer panel (or sash) is the outer-most panel of the sliding window when viewed from inside a building structure. Accordingly, the inner panel is the inner-most panel of the sliding window when viewed from inside a building structure. For purposes herein, an inner pane surface faces inside the building structure and a center rail is the vertical rail of a sliding or fixed panel which meets, in an overlapping relationship, the rail of an adjacent panel while in the window's fully closed position. Sliding windows have an inter-panel gap defined as the gap between the inner pane surface of the window's outer panel and the center rail of the window's adjacent inner panel.

Given the similar construction of a sliding door to a sliding window, the present invention also applies equally to sliding doors. Herein we will use the term sliding closure or closure to refer to a sliding window or a sliding door.

Several types of fasteners have been proposed that are intended to be the primary locking mechanism and were designed as an integral part of the original sliding closure—for example, U.S. Pat. No. 3,078,524 to Minick (1963). One drawback of such fasteners, especially those that exist in older homes, is that the fastener can be easily popped off, broken or disengaged from the outside allowing a would-be criminal to enter therethrough. Another drawback of many such fasteners is that the fastener can only be engaged when the closure is fully closed. If the closure is partially opened to allow for external air circulation, the fastener cannot be engaged and is thus rendered useless as a security device.

Several types of secondary fasteners have been proposed to solve the inherent vulnerabilities and limitations of such primary fasteners, some requiring an invasive installation and others that do not. Most secondary fasteners are designed to provide added security when the sliding closure is fully closed and the primary fastener is in use. In addition, there are secondary fasteners that allow the sliding closure to be limited to or fixed in a partially open position. These secondary fasteners include blocking devices that prevent a sliding closure from being opened beyond the fastener's set position.

For example, in publication number 2007/0194579 by Fiedler (2007) there is proposed a blocking device that clamps to a sliding closure track using a vice or clamping mechanism. Although Fiedler's device can be placed anywhere along the track and does not require an invasive installation, the vice mechanism is inherently weak. With any moderate and repeated force in the opening direction of the sliding closure, the Fiedler device will slip along or disengage from the track, potentially damaging the track in the process.

Another example of a blocking device is in publication number 2007/0209414 by Bentley (2007) where there is proposed an adjustable length blocking bar, one end mounted to the closure frame while the other end blocks the sliding panel from opening past the position corresponding to the bars set length. Although such bar-type blocking devices provide added security, they are large, unsightly and like Bentley's proposed device, the installation requires an invasive mount with screws to attach the device to the closure's frame.

There are other types of secondary fasteners such as pin fasteners that require an invasive procedure of drilling position holes into a closure's panels or frame depending on the closure construction. When the pin is inserted into the aligned positioning holes, the sliding closure is either blocked or fixed in either a closed or partially open position. For example—in U.S. Pat. No. 5,409,271 to Hoffmann (1995), there is proposed a pin latch that firmly sets the sliding closure in a fixed position corresponding to alignment holes in the panels. Although such pin-type fasteners provide added security, they are highly invasive, requiring drill holes for the pin latch and additional positioning holes for each fixed position of the sliding closure.

The secondary fasteners described thus far are specific in varying degrees to the design and construction material of the sliding closure. For example, Fiedler's proposed sliding closure track clamping device (publication number 2007/0194579, 2007) is specific to a sliding closure design with high, thin sliding closure tracks, such as aluminum windows. For purposes herein, a sliding closure track is a member of a sliding closure that carries and channels a sliding panel in the direction of the closure's sliding translation. The sliding closure tracks of wooden or polyvinyl windows and doors are not tall enough or are too soft to be used as a clamping surface, and thus Fiedler's device may not fit or function as intended when applied to such closures. Bentley's proposed adjustable bar device (publication number 2007/0209414, 2007) must be securely mounted on the closure frame and it is claimed that the device can be applied to many different closure types but without any further detail on how to implement the mounting means. For aluminum sliding windows and doors, the frame does not provide a flush surface to which a generalized flat mounting member can be attached, such as the mounting member described by Bentley (publication number 2007/0209414, 2007). Accordingly, different frame materials and designs will require a plurality of mounting means complicating the design. The pin device proposed by Hoffmann (U.S. Pat. No. 5,409,271, 1995) requires that the pin travel through two panels to secure the sliding closure. Wood, aluminum, polyvinyl and other sliding closure materials come in widely varying thicknesses that would require different length pins, again complicating the design.

SUMMARY

In accordance with one embodiment, an adjustable position blocking device for sliding closures comprises an elongated track having elongated hook-shaped edges curving to one side forming a channel, very high bonding double-sided adhesive tape which firmly adheres to the opposing planar surface permitting the track to be firmly attached to the glass pane of a sliding closure panel, and a multi-position blocking slider comprising a flat rigid sliding plate on one side. The rigid sliding plate over-extends slightly on lateral sides forming rails which conform to the channel shape, such that the slider is held in the track with its motion limited to sliding translation along the track. In addition, the track and slider comprise a linear ratcheting mechanism which permits the slider to move in a ratcheting motion along one direction of the track (designated the forward direction), but prevents the slider from moving in the reverse direction. In addition, the slider comprises a release mechanism. When engaged, the release mechanism disengages the linear ratchet mechanism, thereby permitting the slider to move freely in either the forward or reverse direction.

To install and operate the blocking device on a sliding closure, the user attaches the track to the inner pane surface of the closure's outer panel or sash using the double-sided adhesive tape. When installed, the track alone is flat enough to fit between the closure panels so as not to block the sliding closure from being fully opened. To attach the blocking slider on the track, the slider is inserted into one end of the track designated the track entrance and ratcheted with fingers along the forward direction to a user determined position using the linear ratchet and release mechanism. When the slider is set at a the user determined position along the channel, the height of the track and slider combined is sufficiently tall to prevent sliding translation of the closure panels beyond the set position of the slider. The track position, in accordance with one embodiment, is adjacent to the outer panel's center rail with the forward direction of the track pointing directly toward the center rail. In this track position, the closure can be secured in a closed or partially open position.

In addition, the slider can be inserted into the track entrance without regard to the slider's forward or reverse orientation and still be ratcheted in the forward direction and set at different track positions. The benefits of this reversible slider mechanism will become apparent as the description proceeds.

In addition, the slider comprises two components (a universal slider and a blocking module), and a modular attachment means which permits the end-user to easily attach blocking modules of different form and function to the universal slider base which comprises a standardized interlocking attachment end. The universal slider constitutes a variable position attachment base of the slider which attaches to the track. The blocking module which comprises a complimentary interlocking attachment end, constitutes a blocking component of the slider. Customized blocking modules can be easily developed for different closure constructions, for example, sliding windows versus sliding doors. In addition, blocking modules may incorporate an electronic device that can perform multiple functions. For example, when the closure is opened and contacts the device, a switch mechanically attached to a bumper on the blocking device closes, activating the electronic device. An electronic device could be an onboard sound, or light device to alert the possibility of intrusion, or media recording devices to record pictures, video or audio of the intruder, or an onboard wireless device that would communicate with another wireless device, or system to alert the possibility of intrusion, or a combination thereof.

Advantages

Accordingly, several advantages of one or more aspects are as follows: to provide a blocking device that is compact, that is extremely easy to install using a non-invasive procedure that does not require hand tools, that can be universally applied to sliding closures with panels comprising planar glass panes, to provide a blocking device that provides a superior degree of security as compared to other non-invasive blocking devices, to provide a blocking device that allows the closure to be partially opened, as well as fully closed, and to provide a blocking device that incorporates a modular attachment means where the slider comprises two interlocking components that can be assembled easily by the end-user without the use of attachments screws or pins: one component being a universal slider base with an interlocking end and the other being a blocking module with the complimentary interlocking end. The blocking device permits the user to customize the slider with blocking modules of different form to fit different sliding closure constructions (e.g., sliding windows versus sliding doors). In addition, the modular attachment means decreases overall manufacturing complexity since the universal slider base and track can be manufactured and assembled without regard to the form or function of the blocking modules, thereby lowering overall production costs at the factory.

In addition, the modular attachment means permits the use of modules incorporating useful functions (e.g., alarm function) which can be sold separately to and interchanged by the end-user. The purpose of integrating such components is to detect the opening of the closure and alerting the user of the possibility of intrusion using sound and light, or recording the event with pictures, video, or sound. In addition, the module could include a wireless transmitter to send an alert message or other data to another wireless device or system from which the user or a security service can respond. Other advantages of one or more aspects will become more apparent from a consideration of the drawings and ensuing description.

DRAWINGS

Figures

In the drawings, closely related figures have the same number but different alphabetic suffixes.

FIG. 1 is a perspective view of a blocking device for use on closures with smaller inter-panel gaps (e.g., sliding windows as opposed to sliding doors), partially disassembled to show the very high bonding double-sided tape, the track and the blocking slider in accordance with one embodiment;

FIGS. 2*a* to 2*c* shows the top, lateral and rear views of the track component in accordance with the embodiment of FIG. 1;

FIGS. 3*a* and 3*b* shows a partially disassembled side view and a bottom view of the slider in accordance with the embodiment of FIG. 1;

FIGS. 4*a* to 4*c* shows a perspective, lateral, and rear view of the assembled blocking device in accordance with the embodiment of FIG. 1;

FIG. 5*a* is a side perspective exploded view of the block slider in accordance with the embodiment of FIG. 1;

FIG. 5*b* shows a top view of the blocking module and cover assembly in accordance with the embodiment of FIG. 5*a;*

FIGS. 6*a* and 6*b* show a top view of sub-components of the reversible slider in both its forward and reverse orientations, respectively, in accordance with the embodiment of FIG. 1;

FIGS. 7*a* and 7*b* show a top view of sub-components showing the release mechanism in its rested and depressed states, respectively, in accordance with the embodiment of FIG. 1;

FIG. 8*a* shows a top view of the safety latch mechanism and the extent of its movement in accordance with the embodiment of FIG. 1;

FIG. 8*b* shows a partial perspective view of the safety latch and release assembly in accordance with the embodiment of FIG. 1;

FIGS. 9*a* and 9*b* show perspective views of the blocking device in use on a horizontal sliding closure, partially opened, in accordance with the embodiment of FIG. 1;

FIG. 9*c* shows a profile view of the blocking device in use on a horizontal sliding closure, partially opened, in accordance with the embodiment of FIG. 1;

FIGS. 9*d* and 9*e* show perspective views of the blocking device in use on a double hung closure, partially opened, in accordance with the embodiment of FIG. 1;

FIG. 10 is a perspective view of a first additional embodiment of a blocking device for use on closures with larger inter-panel gaps (e.g., sliding doors as opposed to sliding windows);

DRAWINGS

Reference Numerals

Figure 4B:
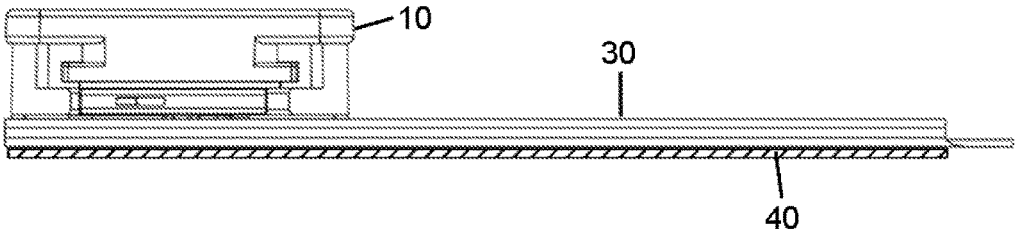

Referring to the reference numerals, like numerals, letters, and combinations there of indicate like elements throughout.

| | |
|---|---|
| FIRST EMBODIMENT | |
| 10 | multi-position blocking slider |
| 11 | slider rails |
| 12 | slider plate |
| 14 | spring |
| 16 | pawl |
| 18 | release lever |
| 18a | top member (release lever) |
| 18b | bottom member (release lever) |
| 18f | release guide aperture |
| 18h | release head |
| 20 | cover |
| 20a | cover mid-section |
| 21 | universal slider base |
| 22 | blocking module |
| 24 | brace plate |
| 30 | track |
| 32 | left hook-shaped edge |
| 34 | right hook-shaped edge |
| 36 | track entrance |
| 38 | track front |
| 39 | attachment side (track) |
| 40 | double-sided adhesive tape |
| 42 | safety latch |
| 44 | sliding button member (safety latch) |
| 45 | channel (safety button) |
| 48 | pawl foot aperture |
| 58 | spring post |
| 60 | pawl post |
| 64 | brace screws |
| 65 | brace screw |
| 66 | center post |
| 67 | stop module screws |
| 68 | head-end (universal slider base) |
| 69 | tail-end (universal slider base) |
| 70 | slider plate wall |
| 76 | finger (on pawl) |
| 77 | groove (left hook-shaped edge) |
| 78 | groove (right hook-shaped edge) |
| 80 | blocking member (blocking module) |
| 81 | bottom flange member (blocking module) |
| 82 | overhanging member (cover) |
| 83 | protrusion (blocking module) |
| 84 | indentation (cover) |
| ADDITIONAL EMBODIMENTS | |
| 86 | stop module (1st add'l) |
| 87 | track (1st add'l) |
| 88 | slider (1st add'l) |
| 90 | slider (2nd add'l) |
| 92 | track (2nd add'l) |
| 94 | track (3rd add'l) |
| 95 | slider (3rd add'l) |
| 96 | stop module (2nd add'l) |
| 97 | bumper (2nd add'l) |
| 102 | buzzer (2nd add'l) |
| 104 | LED (2nd add'l) |
| 106 | wireless transmitter (2nd add'l) |
| 118 | stop module (3rd add'l) |
| OTHER | |
| A | forward direction of track |
| B | partial open window gap |

-continued

| | |
|---|---|
| C | reverse direction of track |
| M | horizontal sliding window |
| Q | outer pane |
| R | center rail (outer panel) |
| T | double hung window |
| V | center rail (inner panel) |

DETAILED DESCRIPTION

FIG. 1 to FIG. 9*b*—First Embodiment

In FIG. 1, there is shown a perspective view of one embodiment, partially disassembled. The embodiment includes a multi-position blocking slider 10, a track 30, and very high bonding double-sided adhesive tape 40.

In FIGS. 2*a* to 2*c*, there is shown atop, lateral, and rear view, respectively, of track 30 in accordance with the embodiment of FIG. 1. Track 30 is an elongated body that comprises two ends; one designated the track entrance 36, and the other the track front 38. The forward direction A is the direction from the track entrance 36 towards the track front 38. The reverse direction C is in the opposing direction of A. In addition, track 30 comprises two elongated hook-shaped edges named the left edge 32 and the right edge 34 curving to one side forming a channel with asymmetric but uniform grooves (77 and 78) shaped into each edge. The side with hook-shaped edges (32 and 34) is designated the attachment side 39.

In FIGS. 3*a* and 3*b*, there is shown a partially disassembled side perspective view and a bottom view of slider 10, respectively, in accordance with the embodiment of FIG. 1. Slider 10 comprises a universal slider base 21 and a blocking module 22. Slider base 21 has two ends designated the head-end 68 and tail-end 69. Base 21 comprises a slider plate 12 having extended rails 11. Slider plate 12 conforms to the channel on attachment side 39 (FIG. 2*c*), such that when plate 12 is slotted into track 30, rails 11 are held in by hooked-shaped edges 32 and 34, limiting the slider 10 movement along track 30. In addition, slider base 21 can be slotted into track entrance 36 with either the head-end 68 or tail-end 69 leading.

Figure 4C:
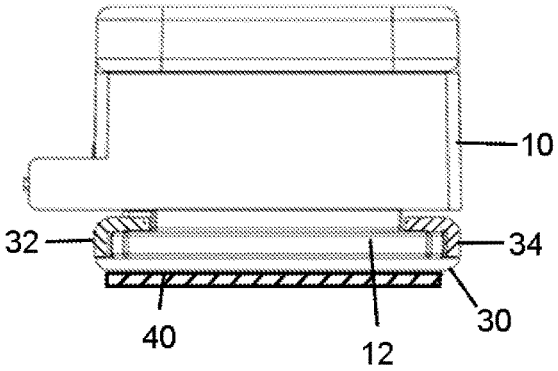

In FIGS. 4*a* to 4*c*, there is shown a perspective view, lateral, and rear view, respectively, of the assembled device in accordance with the embodiment of FIG. 1. Additionally, FIG. 4*a* shows the device with tape 40 peeled back. In FIGS. 4*a* to 4*c*, slider 10 slidably engages with track 30. Tape 40 adheres to the opposing planar surface of track 30. When the device is installed on a closure, double-sided tape 40 firmly adheres to the closure's glass pane, thereby firmly attaching track 30. to the same glass pane. Tape 40 is made from closed cell acrylic foam and is available from 3M of St. Paul, Minn. However, tape 40 can be replaced by any other very high bonding double-sided tape offered by 3M or other tape manufacturer that allows track 30 to firmly adhere to a flat glass pane surface which has excellent properties against peeling, normal, and shearing forces. In many applications, such tapes replace rivets, spot welds, liquid adhesives and other permanent fasteners. In addition, FIG. 4*a* exhibits the sliding translational motion of slider 10 on track 30. The blocking device comprises a linear ratchet means which permits slider 10 movement in the forward direction A, but prevents movement in the reverse direction C. The linear ratchet means is disengaged with a release means which permits slider 10 to be freely adjusted in the forward or reverse direction (A or C). The linear ratchet and release means combined constitute an adjustable position attachment means which will become more apparent as the description proceeds.

Figure 5A:
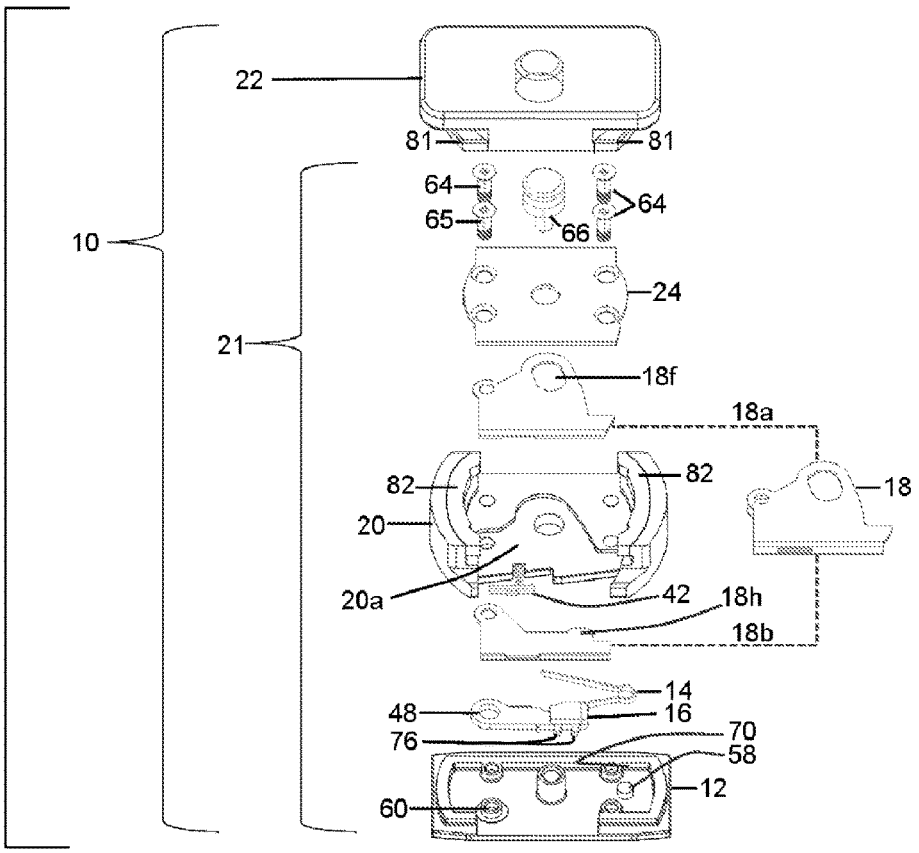

In further detail, in FIG. 5*a*, there is shown a side perspective exploded view of slider 10 in accordance with the embodiment of FIG. 1. Slider base 21 comprises a pawl 16, and a loaded spring 14. Pawl 16 is pivotally attached to a post 60 and comprises fingers 76. Spring 14 presses against and rotatably urges pawl 16 laterally outward, thereby pressing fingers 76 into grooves 77 or 78 of which depends on the slider base 21 orientation with respect to entrance 36 (head-end 68 or tail-end 69 leading). When a force is applied to base 21 in the forward direction A, fingers 76 slide along the gradual sloping sides of grooves 77 or 78 in a ratcheting motion, permitting base 21 to move along track 30. When a force is applied in the reverse direction C, fingers 76 jam into grooves 77 or 78 holding base 21 in place at the set position along track 30. The linear ratchet mechanism described heretofore constitutes the linear ratchet means. Slider base 21 also comprises a pivotally mounted release lever 18 that when depressed, rotates pawl 16 inward disengaging fingers 76 from grooves 77 or 78. The release mechanism described heretofore constitutes the release means.

Still referring to FIG. 5*a*, the attachment means of spring 14 comprises spring 14, under compression, placed between pawl 16 and the apposing slider plate wall 70. The head of spring 14 shaped into an almost full circular arc, loops around a rigid post 58 holding spring 14 in position on plate 12, while still permitting spring 14 to springingly engage with pawl 16.

Still referring to FIG. 5*a*, slider base 21 comprises a cover 20 which firmly attaches to the top of plate 12 using an attachment means forming a housing surrounding spring 14, and pawl 16. The attachment means of cover 20 comprises a rigid brace plate 24 fitted with screws (64 and 65) and a threaded center-post 66, sandwiching cover 20 to plate 12. The attachment means permits cover 20 to be made of a relatively non-rigid, colorful and lighter material, such as plastic, compared to the rigid material of brace plate 24, but still maintain a high degree of strength when a strong lateral or vertical pressure is applied. When brace plate 24 is placed on cover 20, a plurality of apertures on plate 24 and cover 20 line-up with threaded apertures on plate 12. Screws 64 and 65, and threaded center post 66 are then fitted into corresponding apertures and then tightened, securing cover 20 to plate 12 at multiple points.

Still referring to FIG. 5*a*, release lever 18 comprises a contiguous piece of sheet metal, die-cut and folded into a three-sided sleeve with a shape and apertures conforming to cover mid-section 20*a*. When assembled, lever 18 slips onto a lateral side of cover 20 around mid-section 20*a*. In FIG. 5*a*, for descriptive purposes only, release 18 is separated into top member 18*a* comprising an oblong-shaped guide aperture 18*f* and a bottom member 18*b* comprising a release head 18*h*. When assembled, bottom member 18*b* fits between cover 20 and plate 12 with release head 18*h* resting against pawl 16. The attachment means of release lever 18 comprises circular apertures on members 18*a* and 18*b* that line up with post 60 and rotatably attach to post 60 with screw 65. Release 18 rotatably attaches around the same post 60 as pawl 16, eliminating friction between the two components and permitting a smooth tactile feel as they rotate around post 60. In addition, oblong-shaped guide aperture 18*f* lines up with post 66 constraining the rotational movement of release 18.

Figure 6A:
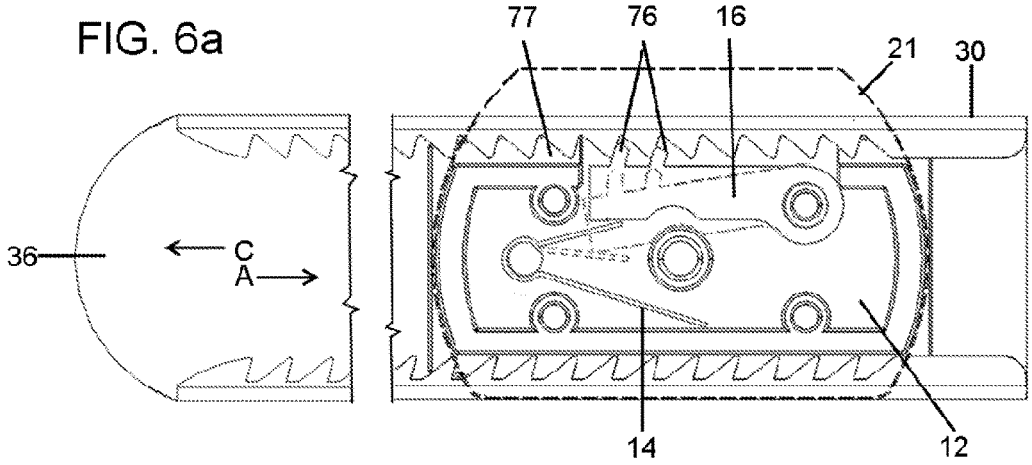
Figure 6B:
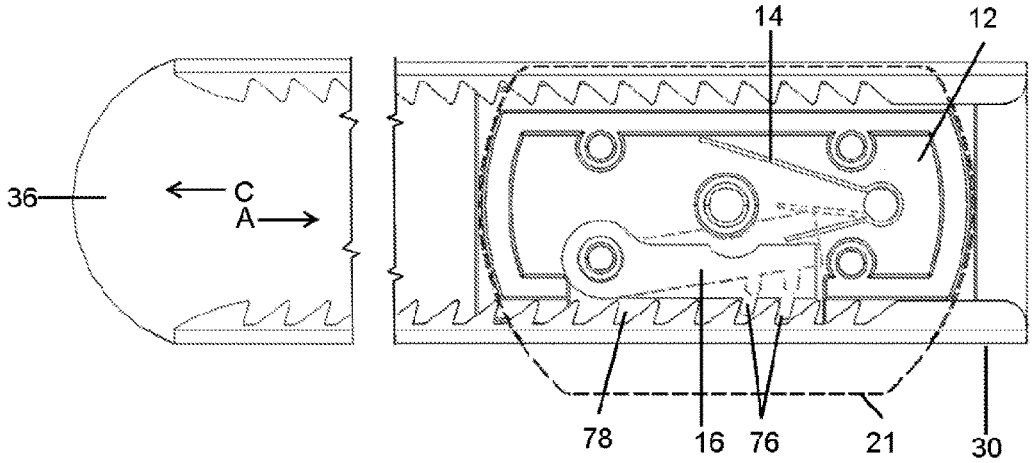

In FIGS. 6*a* and 6*b*, there is shown two orientations of subcomponents (plate 12, spring 14, and pawl 16) of slider base 21 and track 30, in accordance with the embodiment of FIG. 1. In both orientations, spring 14 urges pawl 16 outward, firmly engaging fingers 76 with track grooves 77 (FIG. 6*a*) or 78 (FIG. 6*b*). The first orientation has slider base 21 with its head-end 68 leading, while the second orientation has slider base 21 with its tail-end 69 leading. This mechanism constitutes a reversible slider means whereby in either orientation, slider base 21 can be ratcheted along the positive direction A, but cannot be moved in the reverse direction C. In addition, pawl 16 comprises two fingers 76 that engage with grooves 77 or 78. Two fingers provide additional strength over a single finger when a force is applied in the reverse direction C against slider base 21, such as when a window is forcibly opened against the device. The number of fingers can be as little as one, but additional fingers can be added depending on the strength requirements of the application.

Figure 7A:
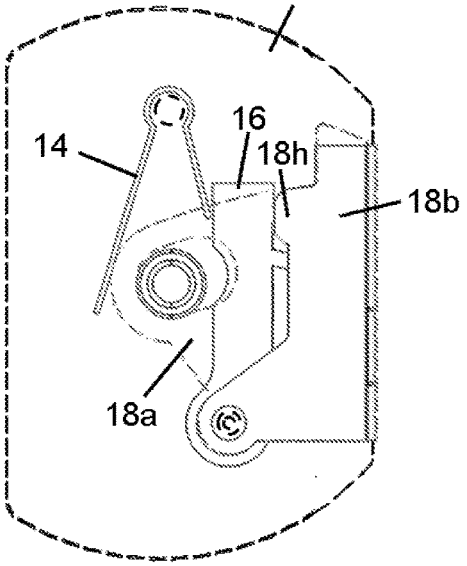
Figure 7B:
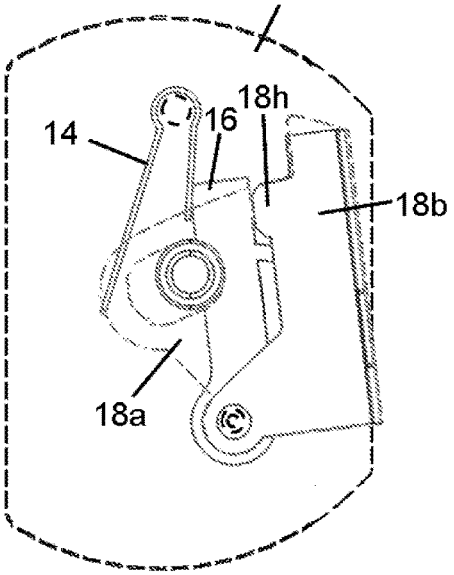

In FIGS. 7*a* and 7*b*, there is shown two more configurations of subcomponents of slider base 21 (spring 14, pawl 16, and release bottom member 18*b*) further showing the release mechanism in accordance with the embodiment of FIG. 1. FIG. 7*a* shows the rested state of release 18, while FIG. 7*b* shows the fully depressed state of release 18. Release 18 makes contact with pawl 16 via member 18*h*. When depressed with fingers, release 18 urges pawl 16 inward against the force of spring 14. FIG. 7*a* and FIG. 7*b* combined exhibit the full extent of movement of spring 14, pawl 16, and release 18 as limited by the shape of release guide aperture 18*f* (FIG. 5*a*).

Figure 8A:
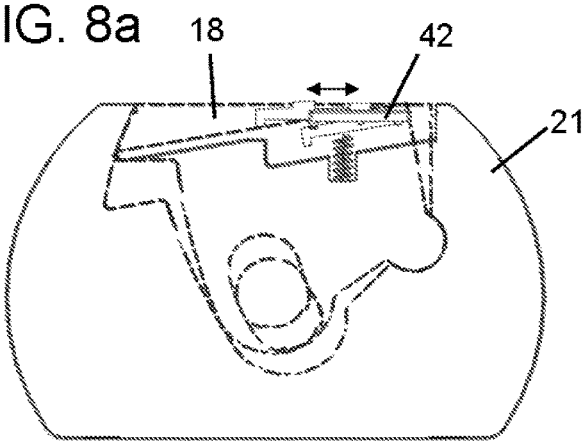
Figure 8B:
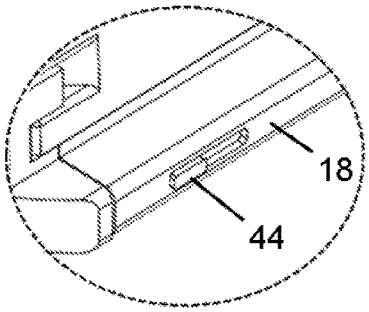

In FIG. 8*a*, there is shown a safety mechanism, in accordance with the embodiment of FIG. 1. The safety mechanism which provides a tamper-resistant means for release 18 comprises a safety latch 42, such that when slid to the left most extent, release 18 cannot be depressed. When latch 42 is slid to the right most extent, release 18 can move between its rested and fully depressed positions. Safety latch 42 comprises a contiguous member safety button 44 which protrudes from channel 45. Using a finger-tip, the user can engage or disengage the safety mechanism by sliding the safety button to the left or right most extent. The attachment means of latch 42 is a channel along the inside of release 18 which holds latch 42 while still permitting slidable engagement.

In other embodiments, spring 14 may be replaced by some other equivalent means that provides an outward force to pawl 16. Pawl 16 may be replaced by some other equivalent means that comprises fingers that press into grooves 77 or 78. The release 18 may be replaced by some other equivalent means that disengages the pawl 16 (or some other equivalent pawl component) from track 30. The safety mechanism may be replaced by some other equivalent means that prevents release 18 (or other equivalent release means) from being engaged when the safety mechanism engaged. Cover 20 and plate 12 may be attached by some other equivalent means that secure the two components together. In addition, slider base 21 and track 30 may be attached by various other equivalent attachment means which allow the two components to be attached in a detent arrangement, such that slider base 21 can be firmly set at a plurality of track 30 positions against a force applied in the reverse direction C. Various other embodiments may have attachment means that provide only a single orientation of the slider base 21.

Referring now to FIG. 5*a*, the slider 10 comprises a blocking module 22 that attaches to the top of cover 20 by an interlocking attachment means. Blocking module 22 comprises blocking member 80 (FIG. 3*a*) which extend over both front and back ends of cover 20 and is the blocking module 22 member that make contact with a closure's inner panel when the device is in use.

Figure 5B:
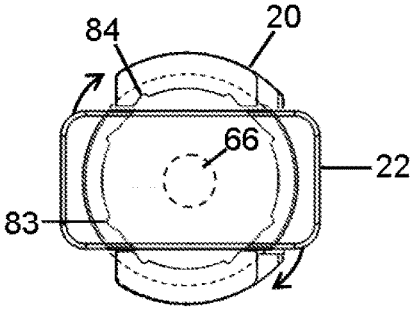

FIG. 5*b* is a top view of the blocking module 22 and cover 20 assembly prior to rotating the blocking module 22 in its final assembled position. Cover 20 comprises two inner-facing overhanging members 82 (FIG. 5*a*) forming underlying channels. Additionally, blocking module 22 comprises two bottom flange members 81 (FIG. 5*a*). The blocking module 22 is placed on cover 20 in a perpendicular orientation permitting it to slot vertically into a center cavity of cover 20. A cylindrical recess on the bottom of blocking module 22 fits onto the attached center post 66. When blocking module 22 is rotated clockwise or counter-clockwise from the perpendicular orientation, the bottom flanges 81 interlock with overhanging members 82. In the final assembled position, protrusions 83 on the inner radial surface of blocking module 22 mate with indentations 84 on cover 20 causing substantial retaining force between cover 20 and blocking module 22 as compared to similar assemblies using multiple screws or pins.

In other embodiments, the assembly may include screws secured through apertures on the side walls of blocking module 22 that when tightened, slot between two rings of post 66, further enhancing the retaining force of the assembly. In other embodiments, the cover 20 and blocking module 22 may be attached by some other equivalent means to secure the two components together.

OPERATION

FIGS. 9*a* to 9*e*

In FIG. 9*a*, there is shown a front perspective view of the blocking device, in accordance with the embodiment of FIG. 1, installed and in use on a partially opened horizontal sliding closure M. The view is from inside of a building structure looking outside. FIG. 9*b* is a subsidiary figure to FIG. 9*a* to show the enlarged view of the blocking device, in accordance with the embodiment of FIG. 1. To install the device, the user attaches track 30 to the inner surface of pane Q of the closure's outer panel. Track 30 firmly adheres to pane Q using tape 40. The outer panel of closure M is the outer-most panel when viewed from inside the building structure. The inner surface of pane Q is the surface facing inside the building structure. The center rail R is the center or meeting rail of the outer panel of closure M. The center rail V is the center or meeting rail of the inner panel of closure M. The track position in accordance with the embodiment of FIG. 1 is adjacent to center rail R on pane Q with the forward direction A oriented directly towards center rail R. When installed, track 30 alone fits between the panels permitting closure M to be fully opened. When slider 10 is attached to track 30, the height of track 30 and slider 10 combined is sufficiently tall to contact the leading edge of center rail V, thereby preventing closure M from opening past the attached position of slider 10. Slider 10 constitutes a blocking component to limit the sliding translation of closure M to the extent of gap B. The device can also secure closure M in its fully closed position by attaching slider 10 to track 30 directly adjacent to meeting rail R.

In FIG. 9*c*, there is shown a side profile view of the blocking device installed on sliding closure M, in accordance with FIG. 9*a*. The view is from the top of closure M looking down. While slider 10 is engaged on track 30, the combined height of slider 10 and track 30 is sufficiently tall, so as to make contact with center rail V of the closure's inner panel.

In FIG. 9*d*, there is shown a front perspective view of the blocking device, in accordance with the embodiment of FIG. 1, vertically installed and in use on a partially open double hung closure T. The view is from inside a building structure looking outside. FIG. 9*e* is a subsidiary figure to FIG. 9*d* to show the enlarged view of the blocking device, in accordance with the embodiment of FIG. 1. The device's applicability to vertical closures is the same as with the horizontal closures except the direction of the device when installed, is vertical rather than horizontal.

In further detail, referring to FIG. 1, track 30 is made sufficiently long to allow slider 10 to be held at a number of useful positions, one being a position to secure a closure in its fully closed position, another being a position to allow the closure to be partially open to allow for external air circulation, for instance, allowing the closure to be open about 10 centimeters. Track 30 is sufficiently flat so that a closure's inner panel can freely pass over track 30, for instance a height of 3 to 6 millimeters. Since track 30 is installed on a closure pane, track 30 should be as narrow as possible to least obstruct the view through the closure, but still have enough bonding area to firmly adhere track 30 to the closure pane, for instance a width of 20 to 30 millimeters.

The embodiment in accordance with FIG. 1 fits a range of closures with smaller inter-panel gaps (e.g., sliding windows as opposed to sliding doors). For the embodiment in accordance with FIG. 1, a slider 10 height of 10 to 30 millimeters would be sufficient. The slider 10 width should be similar to the track 30 width, for instance a width of 20 to 35 millimeters. The slider 10 length should be as short as possible, but requires a minimum length to encase working sub-components, for instance, a length of 4 to 7 centimeters.

The construction details of the blocking device, in accordance to the embodiment of FIG. 1, is that tape 40 is sufficiently high bonding to keep track 30 firmly attached to a glass pane against peeling, normal and shearing forces such that total adhesive force is at least as strong as that of VHB© acrylic foam tape manufactured by 3M of St. Paul, Minn. Track 30 may be made of metal or any other sufficiently rigid and strong material such as high-strength plastic. Plate 12, spring 14, pawl 16, brace 24 and release 18 may be made of metal or any other sufficiently rigid and strong material such as high-strength plastic. Cover 20 and blocking module 22 may be made of high strength plastic or any other sufficiently rigid and strong material such as metal. Safety latch 42 may be made of high-strength plastic or any other sufficiently rigid and strong material such as metal. Brace screws 64 and 65 and center-post 66 may be made of metal or any other sufficiently rigid and strong material such as high-strength plastic. Further, the various components of slider 10 may be made of different materials.

DETAILED DESCRIPTION

FIG. 10—First Additional Embodiment

In FIG. 10, there is shown a perspective view of a first additional embodiment of a blocking device. The components and sub-components of device are the same as those of the embodiment in accordance to FIG. 1, except blocking module 86 is taller than blocking module 22, in order to fit a range of sliding closure constructions with larger inter-pane gaps (e.g., sliding doors as opposed to sliding windows). A slider height of 30 to 45 millimeters would be sufficient. The construction details of the embodiment are the same as the construction details of the embodiment in accordance to FIG. 1.

DETAILED DESCRIPTION

Figure 11:
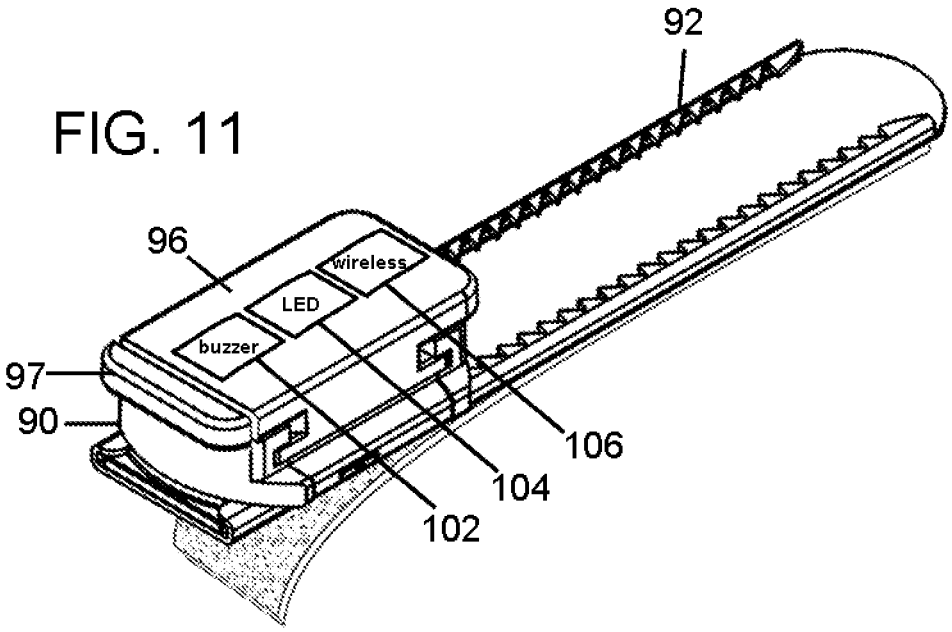
FIG. 11 is a perspective view of a second additional embodiment of a blocking device which can detect the opening of a closure and alert the user and a remote device or system using a light, a buzzer and a wireless transmitter.

FIG. 11—Second Additional Embodiment

In FIG. 11 there is shown a perspective view of a second additional embodiment of a blocking device which contains a device that can detect the opening of a sliding closure and alert the user with a light, sound, and also send an alert to a remote device or system using wireless transmission.

The second additional embodiment comprises the same components and sub-components as those of the embodiment of FIG. 1. In addition, the blocking module 96 contains an electronic device comprising a switch, a battery, a buzzer 102, a light emitting diode (LED) 104, and a wireless transmitter 106, all connected in a circuit. The switch is mechanically connected to a bumper 97 that protrudes from blocking module 96 in the direction of the center rail of the closure's inner panel. When the blocking device is in use and the sliding closure is pushed opened, the center rail of the closure's inner panel will contact bumper 97, closing the switch and activating the electronic device. The emitted sound from the buzzer 102, and the emitted light from the light emitting diode 104 will alert the user locally to the possibility of intrusion. Wireless transmitter 106 will send a wireless transmission comprising an alert message, and possibly other data, to a remote receiver or system which will then take some form of action in response. An example of a response is sending an e-mail or SMS message to a user's mobile phone, or sending an alert to a home security system.

The electronic device can be replaced by other devices comprising different types and numbers, as well as, alternate configurations of electronic components. Slider 90 has the same or slightly larger dimensions compared to slider 10 to accommodate the added electronic device. The construction details of the embodiment are the same as the construction details of the embodiment in accordance to FIG. 1, with additional consideration of the added mechanical and electronic components contained in module 96.

DETAILED DESCRIPTION

Figure 12:
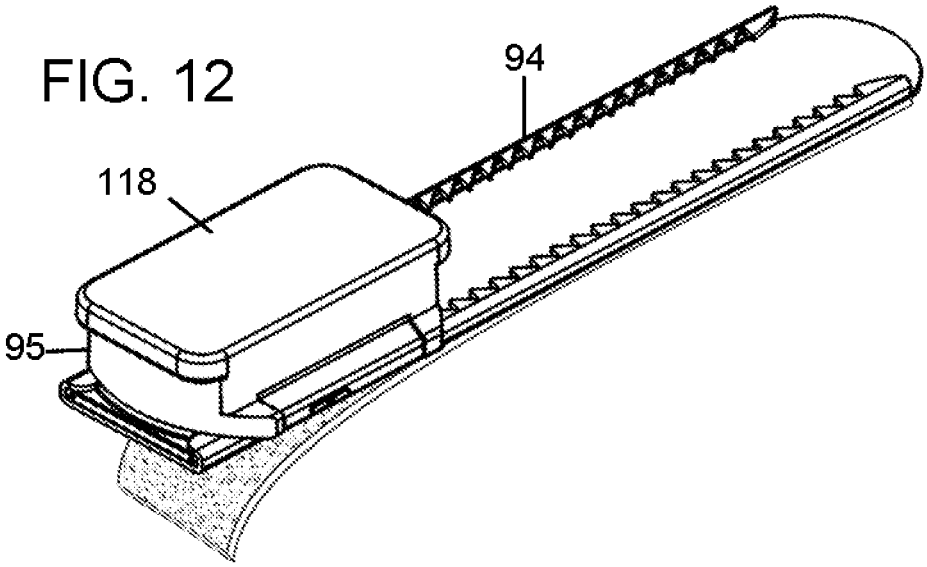
FIG. 12 is a perspective view of a third additional embodiment of a blocking device with the cover and blocking module manufactured as single contiguous member.

FIG. 12—Third Additional Embodiment

In FIG. 12, there is shown a perspective view of a third additional embodiment of a blocking device. The blocking module and cover are manufactured as a single moulded piece 118. The embodiment has the same dimension details as the embodiment in accordance with FIG. 1. The construction details of the embodiment are the same as the construction details of the embodiment in accordance with FIG. 1.

Advantages

From the description above, a number of advantages of some embodiments of my blocking device become evident:

(a) My blocking devices provide a high degree of security for sliding closures, while being non-invasive and non-specific to any sliding closure design or construction when applied to a planar glass surface of a sliding closure panel, and are exceedingly easy to install.

(b) My blocking devices allow the sliding closure to be secured in a closed position or in a partially open position.

For example, the sliding closure can be opened to around 10 centimeters to stop a would-be intruder from reaching inside to disengage the device, but is wide enough to allow air to circulate from the outside.

(c) The slider is reversible while still being able to ratchet in the forward direction of the track. This is highly useful when a track's long edge is positioned adjacent to a closure's side rail leaving insufficient spacing to press the release with normal adult-size fingers. In this situation, the slider's orientation can be reversed giving the user easy access to the release.

(d) My blocking device incorporates a modular attachment means where the slider comprises two interlocking components (a universal slider base and blocking module) that can be assembled easily by the end-user without the use of attachments screws or pins thereby permitting the end-user to customize the device to a target closure. New modules can be easily designed which attach to the top of a universal slider base. Blocking modules can now be independently designed to include, but not limited to, blocking modules of differing heights to accommodate differing inter-panel gaps (e.g., sliding windows versus sliding doors), and blocking modules that contain mechanical and electronic components that are part of a device to detect a closure being opened and alert the user, record the event, or send a message wirelessly to a remote device or a remote system. Some examples of mechanical components are devices that emit sound, or light, record and store sound, pictures, or video, or wirelessly transmit data, such as an alert to a remote device, or system that will in turn send an alert to the user or a security service.

CONCLUSION, RAMIFICATIONS AND SCOPE

Accordingly, the reader will see that the blocking device of the various embodiments can be used as a variable position secondary fastener to secure a sliding closure. Very high bonding double-sided adhesive tape is used to firmly attach the device to a flat surface of a closure's panel making the device exceedingly easy to install. The device is universal to sliding closures comprising flat glass panes and does not require an invasive installation using hand or power tools. The device allows the closure to be secured in a fully closed or partially open position, allowing air circulation from the outside. The slider component is reversible so that when the track is installed, the slider can be oriented for easy access to the release lever. In addition, the device can be easily customized with blocking modules of different form and function. Blocking modules of different heights can accommodate sliding closures with different inter-panel gaps (e.g., sliding windows versus sliding doors). Blocking modules can also integrate mechanical and electronic components to detect the opening of the closure and alert the user, a remote device or a remote system of a possible intrusion, in addition to recording the event with picture, video or sound. Furthermore, the blocking device has further advantages in that:

- it allows the slider shape to be easily modified by changing the plastic mold;
- it allows the slider to be of different colors and patterns using plastic color pigments which can be applied in the mould process rather having to apply paint in a secondary process;
- it incorporates both metal and plastic parts to allow the device to be strong, yet light, functional and beautiful as compared to all metal or all plastic blocking devices; and
- it allows security warning labels and product advertising logos to be printed on the tape surface facing towards the exterior of the building, Although the description above contains many specificities, these should not be construed as limiting the scope of the embodiments but as merely providing illustrations of some of several embodiments. For example, in other embodiments the release lever can be located on the opposite side or rear side of slider; the slider can have other shapes, such as circular, oval, trapezoidal, triangular, etc.; or the release latch can be replaced by a combination or key lock.

Thus the scope of the embodiments should be determined by the appended claims and their legal equivalents, rather than by the examples given.

I claim:

1. An adjustable position blocking device for a sliding closure for limiting sliding translation of sliding panels of said closure, said closure having an interpanel gap defined as the gap between an inner pane surface of an outer panel of said closure and a center rail of an adjacent inner panel of said closure, the adjustable position blocking device comprising:

i. a substantially flat rigid elongated body comprising an entrance side at one end of said elongated body, a front side at an opposing end thereof, a planar surface on one side of said elongated body, an opposing attachment side having a right hooked shaped edge and a left hooked shaped edge forming a channel along said elongated body, and a plurality of predetermined attachment positions along a substantial length of said elongated body, said attachment positions formed of asymmetric grooves shaped into said left hooked shaped edge;

ii. a double-sided adhesive tape wherein one side of said tape may adhere to said planar surface and an opposite side of said tape may adhere to said inner pane surface of said outer panel, such that said tape may maintain said elongated body on said inner pane surface;

iii. a blocking slider comprising a slider base bottomly disposed thereon, said slider base comprising a slider plate on a bottom most extent of said slider base, said slider plate comprising extended rails co-planarly disposed extending outward from lateral sides of said slider plate to the extent that said hook shaped edges may hold said extended rails when said channel slotably receives said slider plate longitudinally disposed, thereby permitting slidable engagement of said blocking slider along said elongated body;

iv. an adjustable position attachment means comprising a linear ratcheting means and a release means for selectively attaching said blocking slider to said elongated body during said slidable engagement, said linear ratcheting means comprising a pawl pivotally mounted to said slider base and coplanarly disposed with said asymmetric grooves, said pawl comprising a pawl finger, oriented such that when said pawl rotates towards said asymmetric grooves said pawl fingers may contact therewith, said pawl under a tension force from a spring urging said pawl towards said asymmetric grooves such that said pawl may ratchetingly engage with said asymmetric grooves in one direction, said one direction defined by a line medially extending from said entrance side to said front side of said elongated body, said ratcheting means permits said blocking slider to be ratcheted along said elongated body in said one direction and selectively attached to one of said predetermined attachment positions, said release means when engaged applies force to said pawl opposing said tension force and may rotate said pawl away from said asymmetric grooves, said release means permits said blocking slider to be freely slidably engaged along said elongated body and selectively attached to another one of said predetermined attachment positions by positioning said blocking slider thereat and disengaging said release means;

v. wherein a total assembled height of said adhesive tape, said elongated body, and said blocking slider is greater than said interpanel gap, such that said blocking slider has sufficient contact with said center rail for limiting sliding translation of said sliding panels.

2. The adjustable position blocking device of claim 1, wherein said release means comprises a lever copivotally mounted with said pawl to said slider base.

3. The adjustable position blocking device of claim 2 comprising a safety means such that engaging said safety means prevents said lever from being engaged, said safety means comprising a safety latch slidably mounted along said lever limited by two predetermined sliding extents, extent one and extent two, such that sliding said safety latch to said extent one permits said lever to be engaged, while sliding said safety latch to said extent two prevents said lever from being engaged.

4. The adjustable position blocking device of claim 1 wherein said blocking slider comprising an electronic device and a bumper, said electronic device comprising a switch, a battery, and circuit components selected from a group comprising a buzzer, a light emitting diode, and a wireless module, said bumper sufficiently protrudes from said blocking slider towards said front end of said elongated body to contact said center rail, said switch is mechanically connected to said bumper, whereby said bumper may be impacted by said center rail during sliding translation of said sliding panels, closing said switch, forming a closed circuit of said circuit components and activating said electronic device.

5. An adjustable position blocking device for a sliding closure for limiting sliding translation of sliding panels of said closure, said closure having an interpanel gap defined as the gap between an inner pane surface of an outer panel of said closure and a center rail of an adjacent inner panel of said closure, the adjustable position blocking device comprising:

i. a substantially flat rigid elongated body comprising an entrance side at one end of said elongated body, a front side at an opposing end thereof, a planar surface on one side of said elongated body, an opposing attachment side having a right hooked shaped edge and a left hooked shaped edge forming a channel along said elongated body, and a plurality of predetermined attachment positions along a substantial length of said elongated body, said attachment positions formed of asymmetric grooves shaped into said right hooked shaped edge;

ii. a double-sided adhesive tape wherein one side of said tape may adhere to said planar surface and an opposite side of said tape may adhere to said inner pane surface of said outer panel, such that said tape may maintain said elongated body on said inner pane surface;

iii. a blocking slider comprising a slider base bottomly disposed thereon, said slider base comprising a slider plate on a bottom most extent of said slider base, said slider plate comprising extended rails co-planarly disposed extending outward from lateral sides of said slider plate to the extent that said hook shaped edges may hold said extended rails when said channel slotably receives said slider plate longitudinally disposed, thereby permitting slidable engagement of said blocking slider along said elongated body;

iv. an adjustable position attachment means comprising a linear ratcheting means and a release means for selectively attaching said blocking slider to said elongated body during said slidable engagement, said linear ratcheting means comprising a pawl pivotally mounted to said slider base and coplanarly disposed with said asymmetric grooves, said pawl comprising a pawl finger, oriented such that when said pawl rotates towards said asymmetric grooves said pawl fingers may contact therewith, said pawl under a tension force from a spring urging said pawl towards said asymmetric grooves such that said pawl may ratchetingly engage with said asymmetric grooves in one direction, said one direction defined by a line medially extending from said entrance side to said front side of said elongated body, said ratcheting means permits said blocking slider to be ratcheted along said elongated body in said one direction and selectively attached to one of said predetermined attachment positions, said release means when engaged applies force to said pawl opposing said tension force and may rotate said pawl away from said asymmetric grooves, said release means permits said blocking slider to be freely slidably engaged along said elongated body and selectively attached to another one of said predetermined attachment positions by positioning said blocking slider thereat and disengaging said release means;

v. wherein a total assembled height of said adhesive tape, said elongated body, and said blocking slider is greater than said interpanel gap, such that said blocking slider has sufficient contact with said center rail for limiting sliding translation of said sliding panels.

6. The adjustable position blocking device of claim 5, wherein said release means comprises a lever copivotally mounted with said pawl to said slider base.

7. The adjustable position blocking device of claim 6 comprising a safety means such that engaging said safety means prevents said lever from being engaged, said safety means comprising a safety latch slidably mounted along said lever limited by two predetermined sliding extents, extent one and extent two, such that sliding said safety latch to said extent one permits said lever to be engaged, while sliding said safety latch to said extent two prevents said lever from being engaged.

8. The adjustable position blocking device of claim 5 wherein said blocking slider comprising an electronic device and a bumper, said electronic device comprising a switch, a battery, and circuit components selected from a group comprising a buzzer, a light emitting diode, and a wireless module, said bumper sufficiently protrudes from said blocking slider towards said front end of said elongated body to contact said center rail, said switch is mechanically connected to said bumper, whereby said bumper may be impacted by said center rail during sliding translation of said sliding panels, closing said switch, forming a closed circuit of said circuit components and activating said electronic device.

* * * * *